US005569975A

United States Patent [19]

Taylor et al.

[11] Patent Number: 5,569,975

[45] Date of Patent: Oct. 29, 1996

[54] CLUSTER ARRANGEMENT OF FIELD EMISSION MICROTIPS

[75] Inventors: Robert H. Taylor, Richardson; Jules D. Levine, Dallas, both of Tex.

[73] Assignee: Texas Instruments Incorporated, Dallas, Tex.

[21] Appl. No.: 378,328

[22] Filed: Jan. 26, 1995

Related U.S. Application Data

[63] Continuation-in-part of Ser. No. 341,829, Nov. 18, 1994.

[51] Int. Cl.[6] ..... H01J 1/30

[52] U.S. Cl. ..... 313/310; 313/309; 313/336; 313/351; 315/169.4

[58] Field of Search ..... 313/309, 310, 313/311, 336, 351; 315/169.4

[56] References Cited

U.S. PATENT DOCUMENTS

| | | | |
|---|---|---|---|
| 3,755,704 | 8/1973 | Spindt et al. | 313/309 |
| 4,857,161 | 8/1989 | Borel et al. | 204/192.26 |
| 4,940,916 | 7/1990 | Borel et al. | 313/306 |
| 5,142,184 | 8/1992 | Kane | 313/309 |
| 5,194,780 | 3/1993 | Meyer | 315/169.3 |
| 5,225,820 | 7/1993 | Clerc | 340/752 |
| 5,283,500 | 2/1994 | Kochanski | 315/58 |
| 5,319,279 | 6/1994 | Watanabe et al. | 313/309 |

FOREIGN PATENT DOCUMENTS

| | | | |
|---|---|---|---|
| 9112624 | 8/1991 | WIPO | 313/309 |

*Primary Examiner*—Sandra L. O'Shea
*Assistant Examiner*—Ashok Patel
*Attorney, Agent, or Firm*—Christopher L. Maginniss; W. James Brady, III; Richard L. Donaldson

[57] ABSTRACT

The emitter plate 60 of a field emission flat panel display device includes a layer 68 of a resistive material and a mesh-like structure 62 of an electrically conductive material. A conductive plate 78 is also formed on top of resistive coating 68 within the spacing defined by the meshes of conductor 62. Microtip emitters 70, illustratively in the shape of cones, are formed on the upper surface of conductive plate 78. With this configuration, all of the microtip emitters 70 will be at an equal potential by virtue of their electrical connection to conductive plate 78. In one embodiment, a single conductive plate 82 is positioned within each mesh spacing of conductor 80; in another embodiment, four conductive plates 92 are symmetrically positioned within each mesh spacing of conductor 90. Also described is an arrangement of emitter clusters including conductive plates 102 having a plurality of microtip emitters 104 formed thereon, or spaced thereform by a thin layer of resistive material, each cluster adjacent and laterally spaced from a stripe conductor 100 by a region 106 of a resistive material. The conductive stripes 100 are substantially parallel to each other, are spaced from one another by two conductive plates 102, and are joined by bus regions 110 outside the active area of the display.

34 Claims, 6 Drawing Sheets

CLUSTER ARRANGEMENT OF FIELD EMISSION MICROTIPS

RELATED APPLICATIONS

This is a continuation-in-part of U.S. patent application Ser. No. 08/341,829, "Cluster Arrangement of Field Emission Microtips on Ballast Layer," filed 18 November 1994, now allowed. This application includes subject matter which is closely related to U.S. patent application Ser. No. 08/378,331, "Clustered Field Emission Microtips Adjacent Stripe Conductors," filed 26 January 1995, now allowed, which is a continuation-inpart of application Ser. No. 08/341,740, filed 18 Nov. 1994.

TECHNICAL FIELD OF THE INVENTION

The present invention relates generally to flat panel displays and, more particularly, to an arrangement of electron-emissive microtip structures, wherein a cluster of microtips are formed on or closely spaced from a conductive plate which is laterally spaced apart from a conductive mesh structure by a resistive medium.

BACKGROUND OF THE INVENTION

The advent of portable computers has created intense demand for displays which are lightweight, compact and power efficient. Since the space available for the display function of these devices precludes the use of a conventional cathode ray tube (CRT), there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color screens tend to be far more costly than CRT's of equal screen size.

As a result of the drawbacks of liquid crystal display technology, thin film field emission display technology has been receiving increasing attention by industry. Flat panel displays utilizing such technology employ a matrix-addressable array of pointed, thin-film, cold field emission cathodes in combination with an anode comprising a phosphor-luminescent screen.

The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued 28 August 1973, to C. A. Spindt et al.; U.S. Pat. No. 4,857,161, "Process for the Production of a Display means by Cathodoluminescence Excited by Field Emission," issued 15 August 1989, to Michel Borel et al.; U.S. Pat. No. 4,940,916, "Electron Source with Micropoint Emissive Cathodes and Display Means by Cathodoluminescence Excited by Field Emission Using Said Source," issued 10 July 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 July 1993, to Jean-Fr édéric Clerc. These patents are incorporated by reference into the present application.

The present invention relates to the use of a resistive layer to provide a ballast against excessive current drawn by the electron emitters. In the prior art, there are two approaches to providing such ballasting. A vertical resistor approach is disclosed in the Borel et al. ('916) patent and discussed in relation to FIG. 1 herein; a lateral resistor approach is disclosed in the Meyer ('780) patent and discussed in relation to FIGS. 2A and 2B herein.

Referring initially to FIG. 1, there is shown, in cross-sectional view, a portion of an illustrative prior art field emission flat panel display device which may be of the type disclosed in the Borel et al. ('916) patent. In this embodiment, the field emission device comprises an anode plate having an cathodoluminescent phosphor coating facing an emitter plate, the phosphor coating being observed from the side opposite to its excitation.

More specifically, the illustrative prior art vertical resistor field emission device of FIG. 1 comprises a cathodoluminescent anode plate 10 and an electron emitter (or cathode) plate 12. The cathode portion of emitter plate 12 includes conductive layer 15 formed on an insulating substrate 18, a resistive layer 16 formed over conductive layer 15, and a multiplicity of electrically conductive microtips 14 formed on resistive layer 16.

A gate electrode comprises a layer of an electrically conductive material 22 which is deposited on an insulating layer 20 which overlies resistive layer 16. Microtip emitters 14 are in the shape of cones which are formed within apertures 34 through conductive layer 22 and insulating layer 20. The thicknesses of gate electrode layer 22 and insulating layer 20 are chosen in such a way that the apex of each microtip 14 is substantially level with the electrically conductive gate electrode layer 22. Conductive layer 22 is arranged as rows of conductive bands across the surface of emitter plate 12, and conductive layer 15 is arranged as columns of conductive bands across the surface of emitter plate 12, the rows of conductive layer 22 being orthogonal to the columns of conductive layer 15, thereby permitting matrix-addressed selection of microtips 14 at the intersection of a row and column corresponding to a pixel.

Anode plate 10 comprises an electrically conductive film 28 deposited on a transparent planar support 26, which is positioned facing gate electrode 22 and parallel thereto, the conductive film 28 being deposited on the surface of support 26 directly facing gate electrode 22. Conductive film 28 may be in the form of a continuous coating across the surface of support 26; alternatively, it may be in the form of electrically isolated stripes comprising three series of parallel conductive bands across the surface of support 26, as taught in U.S. Pat. No. 5,225,820, to Clerc. Anode plate 10 also comprises a cathodoluminescent phosphor coating 24, deposited over conductive film 28 so as to be directly facing and immediately adjacent gate electrode 22. In the Clerc patent, the conductive bands of each series are covered with a phosphor coating which luminesces in one of the three primary colors, red, blue and green.

One or more microtip emitters 14 of the above-described structure are energized by applying a negative potential to conductive layer 15, functioning as the cathode electrode, relative to the gate electrode 22, via voltage supply 30, thereby inducing an electric field which draws electrons from the apexes of microtips 14. The freed electrons are accelerated toward the anode plate 10 which is positively biased by the application of a substantially larger positive voltage from voltage supply 32 coupled between the gate electrode 22 and conductive film 28, functioning as the anode electrode. Energy from the electrons attracted to the anode conductor 28 is transferred to the phosphor coating 24, resulting in luminescence. The electron charge is transferred from phosphor coating 24 to conductive film 28, completing the electrical circuit to voltage supply 32.

The purpose of the resistive layer is to provide a ballast against excessive current in each microtip emitter and consequently homogenize the electron emission. Where the application of the field emission device is the excitation of pixels on a display screen, the resistive layer makes it possible to eliminate excessively bright spots. The resistive layer also makes it possible to reduce breakdown risk at the microtips by limiting the current and thus prevent the appearance of short circuits between rows and columns. Finally, the resistive layer allows the short-circuiting of a few microtip emitters with a gate conductor; the very limited leakage current (a few μamperes) in the short circuits will not affect the operation of the remainder of the cathode conductor.

Borel et al. ('916) recommend a material for use as the resistive layer having a resistivity of between approximately $10^2$ and $10^6$ ohmscm. More particularly, they recommend forming the resistive layer from a material chosen from the group including $In_2O_3$, $SnO_2$, $Fe_2O_3$, ZnO and silicon in doped form.

Unfortunately, the problem caused by the appearance of short circuits between the microtips and the gate electrode is not solved in a satisfactory manner by a device of the type described in the Borel et al. ('916) reference. When a particle causes a short circuit of the microtip with the gate conductor, all of the voltage applied between the gate and the cathode conductor (approximately 70–100 volts) is transferred to the terminals of the resistive coating. In order to accept a few short circuits of this type, which are virtually inevitable in a display panel which may have hundreds of millions of microtip emitters, the resistive coating must be able to withstand a voltage of approximately 100 volts, which requires its thickness to exceed 2 μmeters (microns). Otherwise, it would lead to a breakdown from the effect of the heat, and a complete short circuit would appear between the gate conductor and the cathode conductor, making the electron emission source unusable. However, a resistive coating as thin as 2 microns is bound to have "pinholes" or other defects which will cause a breakdown of the resistive layer between the cathode conductor and microtip emitters.

An improved prior art lateral resistor cathode structure for a field emission device, which may be of the type disclosed in the Meyer ('780) patent, is illustrated in cross-sectional and plan views in FIGS. 2A and 2B, respectively. A microtip emissive cathode electron source is disclosed in this reference including cathode and/or gate conductors which are formed in a mesh structure, the microtip emitters being formed on the resistive layer in a matrix arrangement within the mesh spacings.

More specifically, the illustrative field emission structure 40 of FIGS. 2A and 2B includes a cathode conductor 42 having a mesh-like structure formed on an optional thin silica insulating layer 44 on a glass substrate 46. A resistive layer 48 formed over conductor 42 and insulating layer 44 supports a multiplicity of electrically conductive microtip emitters 50. A gate electrode, comprising a layer of an electrically conductive material 52, is deposited on an insulating layer 54 which overlies resistive layer 48. Microtip emitters 50 are in the shape of cones which are formed on resistive layer 48 within apertures 56 through conductive layer 52 and insulating layer 54. Conductive layer 52 is arranged as rows of conductive bands across the surface of field emission structure 40, and the mesh-like structure comprising cathode conductor 42 is arranged as columns of conductive bands across the surface of field emission structure 40, thereby permitting matrix-addressed selection of microtips 50 at the intersection of a row and column corresponding to a pixel.

This arrangement provides an improvement in breakdown resistance of a field effect microtip emissive device, without requiring an increase in the thickness of the resistive layer. The disclosed mesh-like structure of the cathode conductor (and/or the gate conductor), permits the cathode conductors and the resistive coating of the Meyer patent to lie substantially in the same plane. In this configuration, the breakdown resistance is no longer susceptible to defects in the thickness of the resistive coating; rather, the resistive coating which laterally separates the cathode conductor from the microtip provides a ballast against excessive current. It is therefore sufficient to maintain a distance between the cathode conductor and the microtip which is adequate to prevent breakdown, while still retaining a homogenization effect for which the resistive coating is supplied.

In the aforementioned prior art devices, each microtip is positioned atop a resistive layer. In the Borel et al. ('916) reference, the thickness, or vertical dimension, of the resistive layer provides a ballast against excessive current; in the Meyer reference, the lateral spacing along the resistive layer provides the ballast. The ballast is in the form of a resistive drop such that those microtips drawing the most current have the most resistive drop, thus acting in such a way as to reduce the current per tip. An equivalent circuit of the ballast arrangements of both references would have each tip in series with an individual buffer resistor to limit the field emission current.

However, as can been intuitively recognized from an examination of FIG. 2B, the ballast resistance between microtips 50 and cathode mesh structure 42 varies with the position of the individual microtip 50 within the array. In the illustrated arrangement comprising a four-by-four array, microtip $\mathbf{50}_c$, in the corner of the array, will have a lower ballast resistance than microtip $\mathbf{50}_s$, at a side of the array, which, in turn, will have a lower ballast resistance than microtip $\mathbf{50}_1$, in the interior of the array. The effect of the difference in ballast resistance among the microtips becomes even more pronounced as the size of the array increases, to the point where, in a five- by-five or a six-by-six array, it is believed that the potential at one or more interior microtips will be insufficient to stimulate substantial electron emission. Thus, an arrangement is desired which will permit all of the microtips to be at a substantially equal potential.

Such an arrangement, however, must be cast within the restraints of the physical and electrical requirements of the system. First, in order to prevent excessive current from being used by a failed emitter microtip, the distance from the conductive cathode mesh to each microtip must be kept relatively large, i.e., a highly resistive path must be maintained between the mesh and each tip. Second, an optimal design dictates equal spacing from the conductive mesh to each microtip so that each tip will have equal emission and degradation characteristics.

Opposing the need for equal distances from each microtip to the conductive mesh is the need to pack as many microtips as possible into a small area to thereby reduce the emission current from each microtip. This need for dense packing can best be realized by having large clusters of microtips, with the extreme case being a complete array of microtips the size of the final display pixel. Unfortunately, the larger the cluster the greater the variation in tip to tip emissions due to resistive path differences to the conductive cathode mesh.

In view of the above, it is clear that there exists a need for an improved emitter structure for use in a field emission flat panel display device which provides ballasting against excessive current in each array of microtip emitters accompanied by improved uniformity of the electron emission from each microtip, while also permitting a high density of microtips on the emitter structure.

SUMMARY OF THE INVENTION

In accordance with the principles of the present invention, there is disclosed herein an electron emission apparatus which comprises a conductive mesh structure defining a mesh spacing, and a conductive plate laterally spaced from the mesh structure and occupying a central region within the mesh spacing. The apparatus futher comprises a resistive layer in electrical contact with the mesh structure and the conductive plate, and a plurality of microtip emitters located in the central region.

Further in accordance with the present invention there is disclosed an electron emission apparatus which comprises an insulating substrate, a conductor formed as a mesh structure on the substrate, the mesh structure defining mesh spaces, and conductive plates on the insulating substrate occupying areas within the mesh spaces. The apparatus also comprises a layer of an electrically resistive material on the substrate overlying the mesh structure and the conductive plates. The apparatus further comprises an electrically insulating layer on the resistive layer, and a conductive layer on the insulating layer, the conductive layer having a plurality of apertures formed therein and extending through the insulating layer. Finally, the apparatus comprises microtip emitters on the resistive layer, each emitter formed within a corresponding one of the apertures in the conductive layer.

Still further in accordance with the present invention, there is disclosed a method for fabricating an electron emission apparatus. The method comprises the following steps: providing an insulating substrate; depositing a first layer of conductive material on the substrate and forming a mesh structure and conductive plates therefrom, the conductive plates being formed within mesh spaces defined by the mesh structure; forming a layer of an electrically resistive material on the substrate overlying the mesh structure and the conductive plates; forming an electrically insulating layer on the resistive layer; forming a second conductive layer on the insulating layer; forming apertures in the second conductive layer over the conductive plates, the apertures extending through the insulating layer; and forming microtip emitters on the resistive layer, each emitter formed within a corresponding one of the apertures in the second conductive layer.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 3:
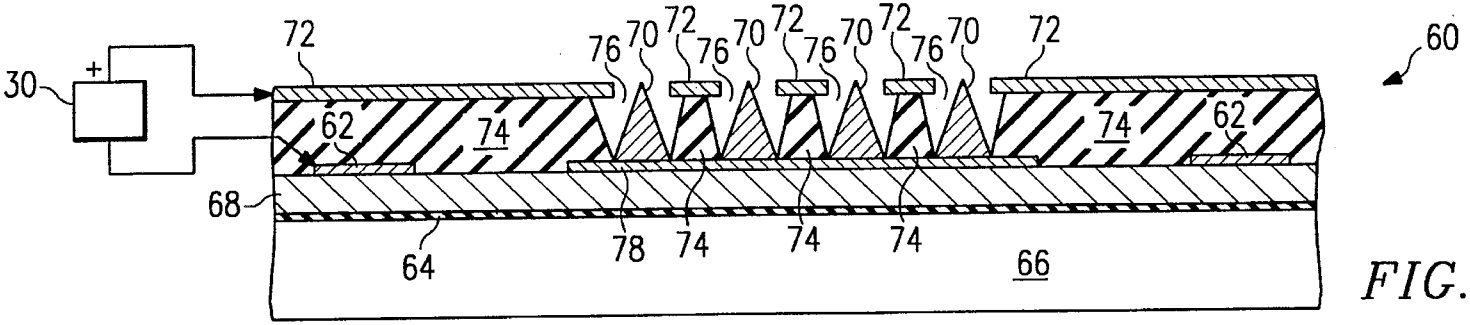
FIG. 3 is a cross-sectional view of a portion of a field emission device illustrating an emitter cluster within a conductive mesh in accordance with the present invention.

Referring now to FIG. 3, there is shown, in cross-sectional view, the emitter plate 60 of an illustrative field emission flat panel display device in accordance with a first embodiment of the present invention. More specifically, the emitter plate 60 of FIG. 3 comprises a substrate 66 having an optional thin insulating layer 64 overlaid thereon. Insulating layer 64 may be included to enhance the adhesion of a subsequent layer to substrate 66 and to limit diffusion of impurities from substrate 66 to the subsequent layer. A coating 68 of a resistive material overlies insulating layer 64, and a mesh-like structure 62 of an electrically conductive material, which may be similar to the type described in the Meyer ('780) patent, is formed over coating 68, the arrangement of the conductive meshes of structure 62 defining spaces enclosed therein.

in accordance with the present invention, a conductive plate 78 is also formed on top of resistive coating 68 within the spacing defined by the meshes of conductor 62. An insulating layer 74 covers resistive coating 68, conductive mesh structure 62 and conductive plate 78, and a conductive layer 72 overlies insulating layer 74. Microtip emitters 70, illustratively in the shape of cones, are formed on the upper surface of conductive plate 78 within apertures 76, which extend through conductive layer 72 and insulating layer 74 down to plate 78.

Electron emission from microtips 70 is stimulated by the application of a first potential to the conductors of mesh structure 62, functioning as a cathode, and the application of a second, more positive potential to conductive layer 72, functioning as a gate electrode. With this configuration, all of the microtip emitters 70 will be at an equal potential by virtue of their electrical connection to conductive plate 78, and their emission characteristics will therefore be substantially more uniform than prior art approaches.

Figure 1:
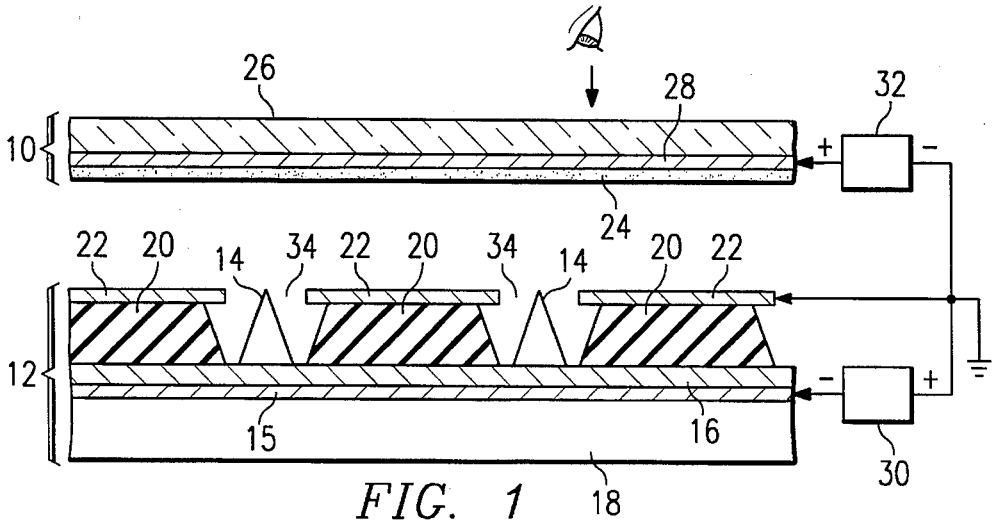
FIG. 1 (PRIOR ART)
FIG. 1 is a cross-sectional view of a portion of a field emission device in accordance with the prior art discussed earlier.
Figure 2A:
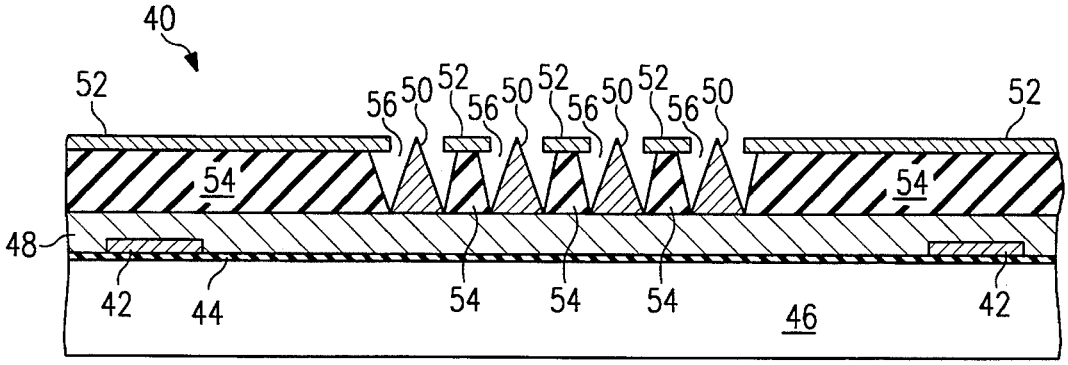
FIG. 2A (PRIOR ART)
FIGS. 2A and 2B are cross-sectional and plan views, respectively, of a portion of an improved prior art field emission device discussed earlier.
Figure 2B:
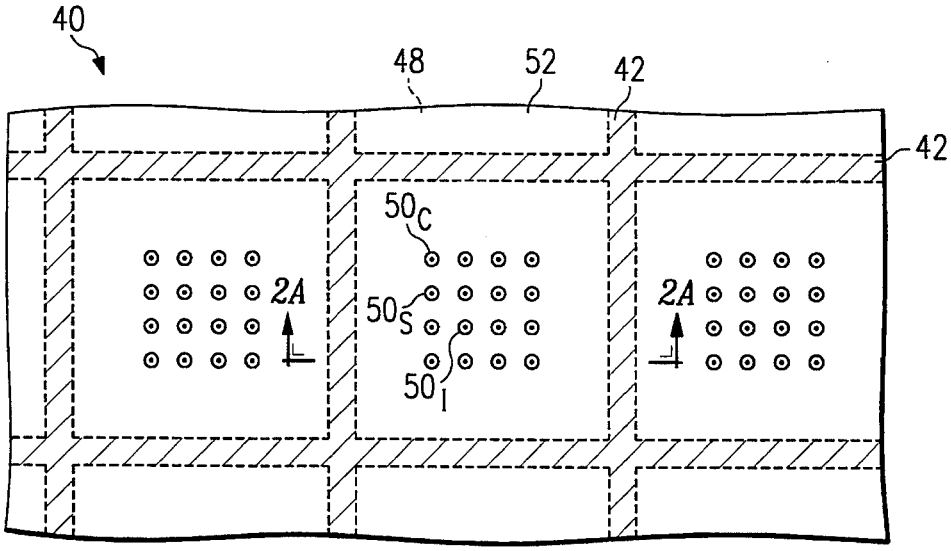
FIG. 2B (PRIOR ART)

The view provided by FIG. 3 illustrates only a small portion of emitter plate 60. In practice, microtip emitters 70 are preferably configured in arrays, typically of the type shown in FIG. 2B; furthermore, emitter plate 60 is preferably arranged in a row-and-column matrix for purposes of selecting individual pixels of the display. By way of example, the conductive layer 72 comprising the gate electrode may be arranged as rows of conductive bands across the surface of emitter plate 60, and the conductive mesh structure 62 comprising the cathode conductor may be arranged as columns of conductive bands across the surface of emitter plate 60, the rows of conductive layer 72 typically being orthogonal to the columns of conductive mesh structure 62, thereby permitting matrix-addressed selection of the microtips 70 at the intersection of a row and column corresponding to a pixel.

By way of illustration, substrate 66 may comprise glass, and insulating layer 64 may comprise silicon dioxide ($SiO_2$) having a thickness of approximately 50 nanometers. Resistive layer 68 may comprise amorphous silicon ($\alpha$-Si) having a thickness of approximately 0.5 to 2.0 microns, and insulating layer 74 may comprise $SiO_2$, having a thickness of approximately 1.0 micron. Conductive mesh 62 may be made of aluminum, molybdenum, chromium, niobium or the like, and have a width of approximately 4 microns and a thickness of approximately 0.2 micron. Conductive plate 78 may comprise any of the aforementioned metal conductors, and have a thickness of approximately 0.2 micron. Conductive layer 72 may be made of niobium and have a thickness of approximately 0.4 micron; the diameters of apertures 76 in conductive layer 72 may typically be 1.4 microns. Microtips 70 are typically made of molybdenum and are formed such that their apexes are substantially level with the top surface of conductive layer 72.

A method for fabricating emitter plate 60, in accordance with the present invention, may comprise the following steps: providing an insulating substrate 66; depositing a layer 64 of $SiO_2$ on substrate 66; forming a layer 68 of an electrically resistive material over layer 64; depositing a layer of conductive material on resistive layer 68 and forming conductive mesh structure 62 and conductive plates 78 within the spaces defined by the conductors of structure 62 therefrom, typically by photolithographic and etching processes; forming an electrically insulating layer 74 overlying resistive layer 68, mesh structure 62 and conductive plates 78; forming a conductive layer 72 on insulating layer 74; forming a plurality of apertures 76 in conductive layer 72 over conductive plates 78, the apertures 76 extending through insulating layer 74 down to conductive plates 78; and forming microtip emitters 70 on conductive plates 78, each emitter 70 formed within one of the apertures 76 in conductive layer 72.

The above-described method may be more fully understood by reference to the following illustrative process. A glass substrate 66 is coated with a thin insulating layer 64, typically $SiO_2$, which may be sputter deposited to a thickness of 50 nm. A resistive layer 68 is added by sputtering amorphous silicon ($\alpha$-Si) onto the $SiO_2$ layer 64 to a thickness of approximately 500–2000 nm; alternatively the amorphous silicon may be deposited by a chemical vapor deposition (CVD) process.

A layer of a conductive material, which may typically comprise aluminum, molybdenum, chromium or niobium, is deposited over resistive layer 68 to a thickness of approximately 200 nm. A layer of photoresist is spun on over the conductive layer to a thickness of approximately 1000 nm. A patterned mask is disposed over the light-sensitive photoresist layer, exposing desired regions of the photoresist to light, thereby defining the cathode mesh structure 62 and the conductive plates 78. In the case of an illustrative positive photoresist, the exposed regions are removed during a developing step, which may comprise soaking the assembly in a caustic or basic chemical developer. The developer removes the unwanted photoresist regions which were exposed to light. The exposed regions of the conductive layer are then removed, typically by a reactive ion etch (RIE) process using sulfur hexafluoride ($SF_6$). In the case of an aluminum conductive layer, the etchant may comprise boron trichloride ($BCl_3$). The remaining photoresist is removed by dry ashing in oxygen plasma or stripping solutions known in semiconductor manufacturing processes, leaving the cathode mesh structure 62 and the conductive plates 78 over resistive layer 68.

An electrically insulating layer 74, illustratively comprising $SiO_2$, is deposited over resistive layer 68, cathode mesh structure 62 and the conductive plates 78 to a thickness of approximately 1000 nm. A second layer 72 of a conductive material, which may typically comprise aluminum, molybdenum, chromium or niobium, is deposited over insulating layer 74, typically by e-beam evaporation, to a thickness of approximately 400 nm. A layer of photoresist is spun on over this second conductive layer 72 to a thickness of approximately 1000 nm. A patterned mask is disposed over the light-sensitive photoresist layer, exposing desired regions of the photoresist to light, thereby defining an array of apertures 76 which are positioned directly over conductive plate 78. In the case of an illustrative positive photoresist, the regions of photoresist which were exposed to light are removed during a developing step. The uncovered regions of the second conductive layer 72, comprising apertures 76, are then removed, typically by a reactive ion etch (RIE) process using sulfur hexafluoride ($SF_6$). In the case of an aluminum conductive layer, the etchant may comprise boron trichloride ($BCl_3$).

Conductive layer 72 may then be used as a mask to dry etch apertures 76 in insulating layer 74 down to conductive plate 78 with an etchant such as $CF_4$. Insulating layer 74 may then be undercut by a subsequent wet etch process using with diluted (buffered) HF. This undercutting of insulating layer 74 helps eliminate shorts between microtip emitters 70 (the cathode electrodes) and conductive layer 72 (the gate electrode), and it may facilitate better microtip formation at a subsequent process step in the manufacture of the flat panel display. The remaining photoresist layer 54 may then be removed by a dry etch process oxygen plasma or a commercial stripper solution.

The process of forming microtip emitters 70 may follow the method described in the Borel et al. ('161) patent. The microtip emitters 70 are formed by first depositing a parting layer comprising, e.g., nickel, by vacuum evaporation at a glancing angle with respect to the surface of the structure, thus ensuring that the parting layer material is not deposited on the apertured inner walls of insulating layer 74. This is followed by the deposition of a conductive coating comprising, e.g., molybdenum, on the complete structure at a substantially normal incidence, thereby forming the cone-shaped emitters 70 within apertures 76. The nickel parting layer is then selectively dissolved by an electrochemical process so as to expose the apertured conductive layer 72 and bring about the appearance of the electron emitting microtips 70.

Figure 4:
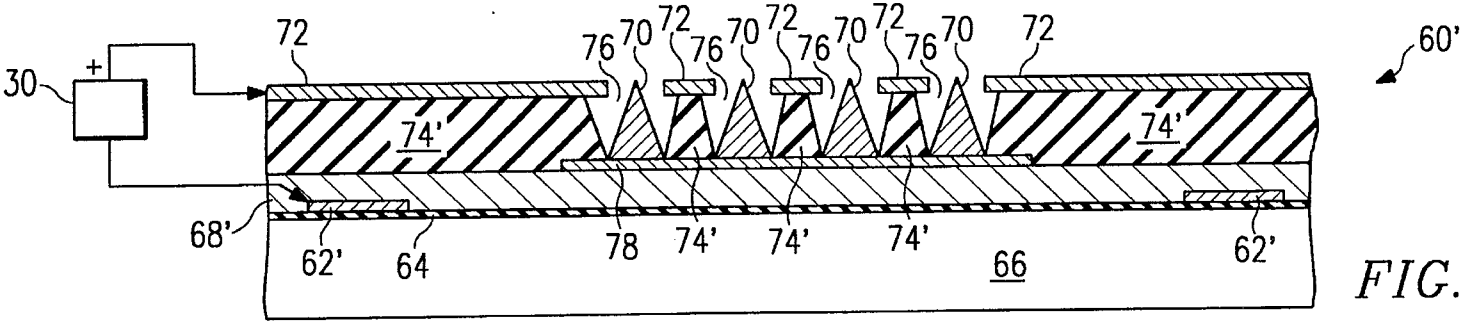
FIG. 4 is a cross-sectional view of a portion of a field emission device illustrating an emitter cluster within a conductive mesh in accordance with a second embodiment of the present invention.
Figure 5:
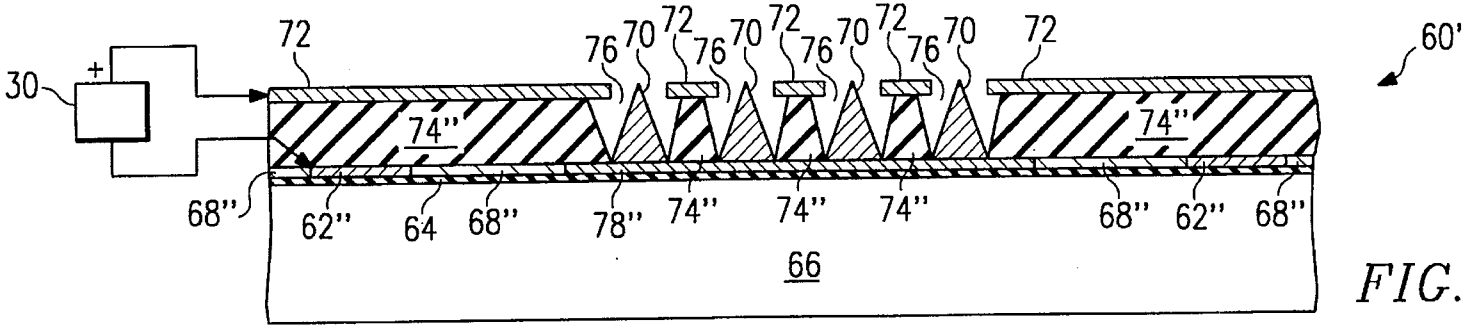
FIG. 5 is a cross-sectional view of a portion of a field emission device illustrating an emitter cluster within a conductive mesh in accordance with a third embodiment of the present invention.

In subsequent paragraphs, relating to FIGS. 4 and 5, elements which are identical to those already described in relation to FIG. 3 are given identical numerical designators. Those elements which are similar in structure and which perform identical functions to those already described in relation to FIG. 3, are given the primed or double-primed numerical designators of their counterparts.

Referring now to FIG. 4, there is shown, in cross-sectional view, the emitter plate 60' of an illustravtive field emission flat panel display device in accordance with a second embodiment of the present invention. More specifically, the emitter plate 60' of FIG. 4 comprises a substrate 66 having an optional thin insulating layer 64 overlaid thereon. A mesh-like structure 62' of an electrically conductive material, which may be similar to the type described in the Meyer ('780) patent, is formed over insulating layer 64, the arrangement of the meshes of structure 62' defining spaces enclosed therein. A coating 68' of a resistive material overlies insulating layer 64 and conductive mesh structure 62'.

In accordance with the present invention, a conductive plate 78 is formed on top of resistive coating 68' within the spacing defined by the meshes of conductor 62'. An insulating layer 74' covers resistive coating 68' and conductive plate 78, and a conductive layer 72 overlies insulating layer 74'. Microtip emitters 70, illustratively in the shape of cones, are formed on the upper surface of conductive plate 78 within apertures 76, which extend through conductive layer 72 and insulating layer 74' down to plate 78.

A method for fabricating emitter plate 60', in accordance with the present invention, may comprise the following steps: providing an insulating substrate 66; depositing a layer 64 of $SiO_2$ on substrate 66; depositing a layer of conductive material on layer 64 and forming conductive mesh structure 62' therefrom, typically by photolithographic and etching processes; forming a layer 68' of an electrically resistive material over layer 64 and over conductive mesh structure 62'; depositing a layer of conductive material on resistive layer 68' and forming conductive plates 78 therefrom within the spaces defined by conductor 62', typically by photolithographic and etching processes; forming an electrically insulating layer 74' on resistive layer 68' and on conductive plates 78; forming a conductive layer 72 on insulating layer 74'; forming a plurality of apertures 76 in conducting layer 72 over conductive plates 78, the apertures 76 extending through insulating layer 74' down to conductive plates 78; and forming microtip emitters 70 on conductive plates 78, each emitter 70 formed within one of the apertures 76 in conductive layer 72. The particulars of illustrative materials and dimensions, and illustrative methods of forming the layers, structures, apertures and microtips of the emitter structure 60' may be easily determined from an understanding of the above-described process of fabricating emitter structure 60.

Referring now to FIG. 5, there is shown, in cross-sectional view, the emitter plate 60" of an illustrative field emission flat panel display device in accordance with a third embodiment of the present invention. More specifically, the emitter plate 60" of FIG. 5 comprises a substrate 66 having an optional thin insulating layer 64 overlaid thereon. A mesh-like structure 62" of an electrically conductive material, which may be similar to the type described in the Meyer ('780) patent, is formed on insulating layer 64, the arrangement of conductive meshes of structure 62" defining spaces enclosed therein.

In accordance with the present invention, a conductive plate 78" is also formed on insulating layer 64 within the spacing defined by the meshes of conductor 62". A coating 68" of a resistive material overlies insulating layer 64 in the regions separating mesh structure 62" and conductive plate 78". An insulating layer 74" covers resistive coating 68", conductive mesh structure 62" and conductive plate 78", and a conductive layer 72 overlies insulating layer 74". Microtip emitters 70, illustratively in the shape of cones, are formed on the upper surface of conductive plate 78" within apertures 76, which extend through conductive layer 72 and insulating layer 74" down to plate 78".

A method for fabricating emitter plate 60", in accordance with the present invention, may comprise the following steps: providing an insulating substrate 66; depositing a layer 64 of $SiO_2$ on substrate 66; depositing a layer of conductive material on layer 64 and forming conductive mesh structure 62" and conductive plates 78" within the spaces defined by the conductors of structure 62" therefrom, typically by photolithographic and etching processes; forming a layer 68" of an electrically resistive material on layer 64 in the regions separating mesh structure 62" and conductive plates 78"; forming an electrically insulating layer 74" on resistive layer 68", mesh structure 62" and conductive plates 78"; forming a conductive layer 72 on insulating layer 74"; forming a plurality of apertures 76 in conductive layer 72 over conductive plates 78", the apertures 76 extending through insulating layer 74" down to conductive plates 78"; and forming microtip emitters 70 on conductive plates 78", each emitter 70 formed within one of the apertures 76 in conductive layer 72. The particulars of illustrative materials and dimensions, and illustrative methods of forming the layers, structures, apertures and microtips of the emitter structure 60" may be easily determined from an understanding of the above-described process of fabricating emitter structure 60.

Figure 10:
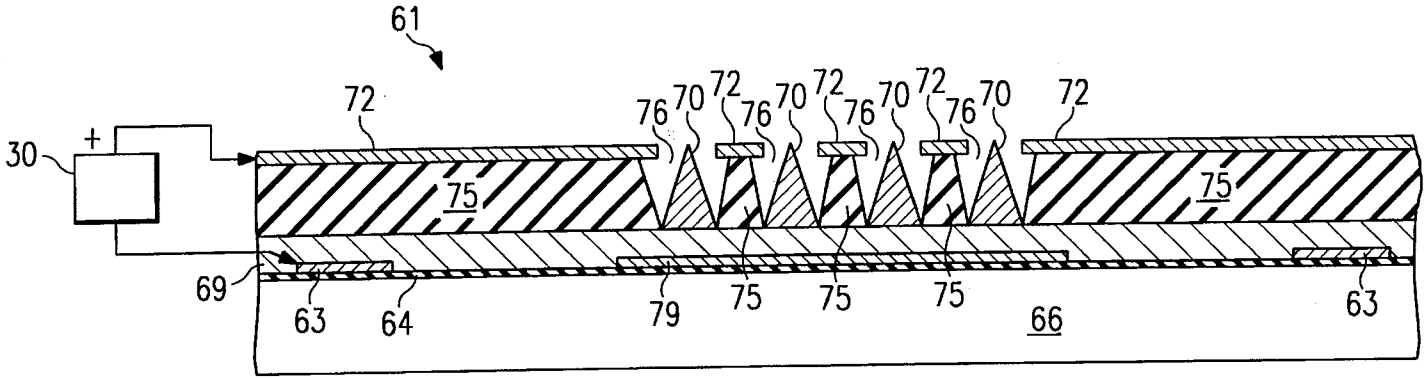
FIG. 10 is a cross-sectional view of a portion of a field emission device illustrating an emitter cluster within a conductive mesh in accordance with a fourth embodiment of the present invention.

Referring now to FIG. 10, there is shown, in cross-sectional view, the emitter plate 61 of an illustrative field emission flat panel display device in accordance with a fourth embodiment of the present invention. More specifically, the emitter plate 61 of FIG. 10 comprises a substrate 66 having an optional thin insulating layer 64 overlaid thereon. A mesh-like structure 63 of an electrically conductive material, which may be similar to the type described in the Meyer ('780) patent, is formed on insulating layer 64, the arrangement of conductive meshes of structure 63 defining spaces enclosed therein.

In accordance with the present invention, a conductive plate 79 is also formed on insulating layer 64 within a space defined by the mesh of conductor 63. A coating 69 of a resistive material overlies insulating layer 64, conductive mesh structure 63 and conductive plate 79. An insulating layer 75 covers resistive coating 69, and a conductive layer 72 overlies insulating layer 75. Apertures 76 are formed through conductive layer 72 and insulating layer 75 down to the upper surface of resistive layer 69. Apertures 76 are formed within the space of mesh structure 63 directly above conductive plate 79. Microtip emitters 70, illustratively in the shape of cones, are formed on the upper surface of resistive layer 69 within apertures 76.

in this arrangement, conductive mesh structure 63 comprises the cathode electrode, and conductive layer 72 comprises the gate electrode of field emission device 61. Electron emission from microtip emitters 70 is effected by the application of a potential at conductive mesh structure 63 which is positive with respect to the potential on conductive layer 72.

The structure shown in FIG. 10 may include a typical thickness dimension of resistive layer 69 between microtip emitters 70 and conductive plate 79 of one micron, and a typical lateral spacing between each conductive plate 79 and the conductive mesh structure 63 of five microns. Thus, the arrangement of FIG. 10 provides a relatively small vertical ballast resistance between each microtip emitter 70 and the conductive plate 79 thereunder, and a considerably larger lateral ballast resistance between each conductive plate 79 and the conductive mesh structure 63.

A method for fabricating emitter plate 61, in accordance with the present invention, may comprise the following steps: providing an insulating substrate 66; depositing a layer 64 of $SiO_2$ on substrate 66; depositing a layer of conductive material, illustratively aluminum, chromium, molybdenum or niobium, on layer 64 and forming conductive mesh structure 63 and conductive plates 79 within the spaces defined by the conductors of structure 63 therefrom, typically by photolithographic and etching processes; forming a layer 69 of an electrically resistive material, illustratively amorphous silicon, on layer 64 overlying mesh structure 63 and conductive plates 79; forming an electrically insulating layer 75 on resistive layer 69; depositing a layer of conductive material, illustratively niobium, on insulating layer 75 and forming row conductors 72 therefrom, typically by photolithographic and etching processes; forming a plurality of apertures 76 in conductive layer 72 over conductive plates 79, the apertures 76 extending through insulating layer 75 down to resistive layer 69; and forming microtip emitters 70, illustratively of molybdenum, on resistive layer 69, each emitter 70 formed within one of the apertures 76 in conductive layer 72. The particulars of illustrative materials and dimensions, and illustrative methods of forming the layers, structures, apertures and microtips of the emitter structure 61 may be easily determined from an understanding of the above-described process of fabricating emitter structure 60.

Figure 6:
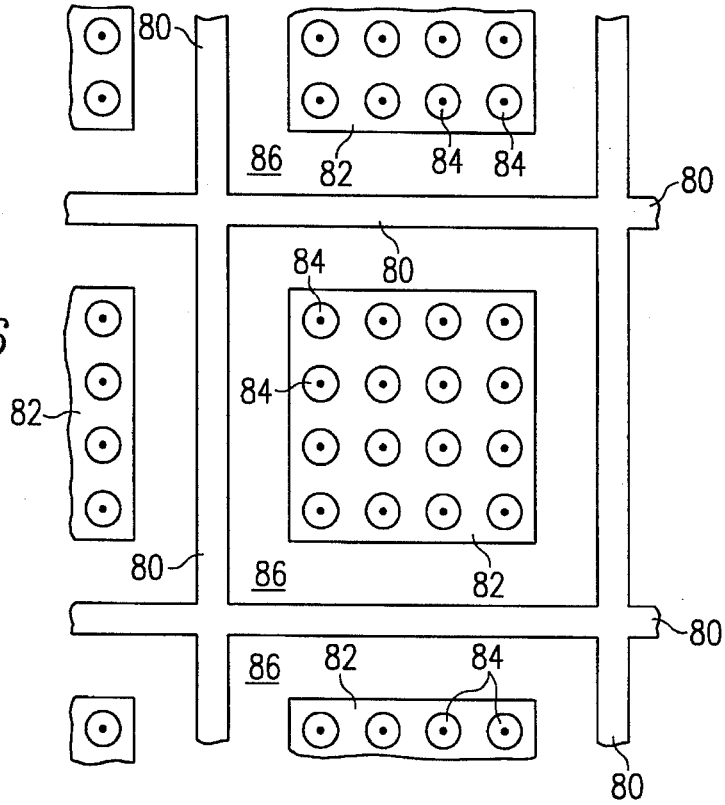
FIG. 6 is a plan view of a first arrangement of the emitter clusters of the present invention.

Referring now to FIG. 6, there is shown a plan view of a first arrangement of emitter clusters according to the embodiments of the present invention as illustrated in FIGS. 3, 4 and 5. The view shown by FIG. 6 is similar to that which would be presented by the embodiment of FIG. 3 with conductive layer 72 and insulating layer 74 removed. FIG. 6 depicts a mesh structure 80 of conductors, conductive plates 82 within the spaces formed by mesh structure 80, a plurality of microtips 84 on each of the conductive plates 82, and regions 86 of resistive material in the spacings between mesh conductor 80 and conductive plates 82. In this illustrated embodiment, microtips 84 are formed as a four-by-four array on conductive plates 82, all of the plates 82 including an equal number of microtips 84.

In this embodiment, there is an equal resistance between conductor 80 and each microtip 84 on a conductive plate 82, regardless of the number of microtips 84 on a plate 82. The resistance value is determined by the lengths of the sides of plate 82, the distance between plate 82 and conductor 80, and the sheet resistance of the material in region 86. Hence, each microtip 84 on a single plate 82 is at an equal potential, regardless of its position on the plate, and should display substantially equal emission and degradation characteristics.

Figure 7:
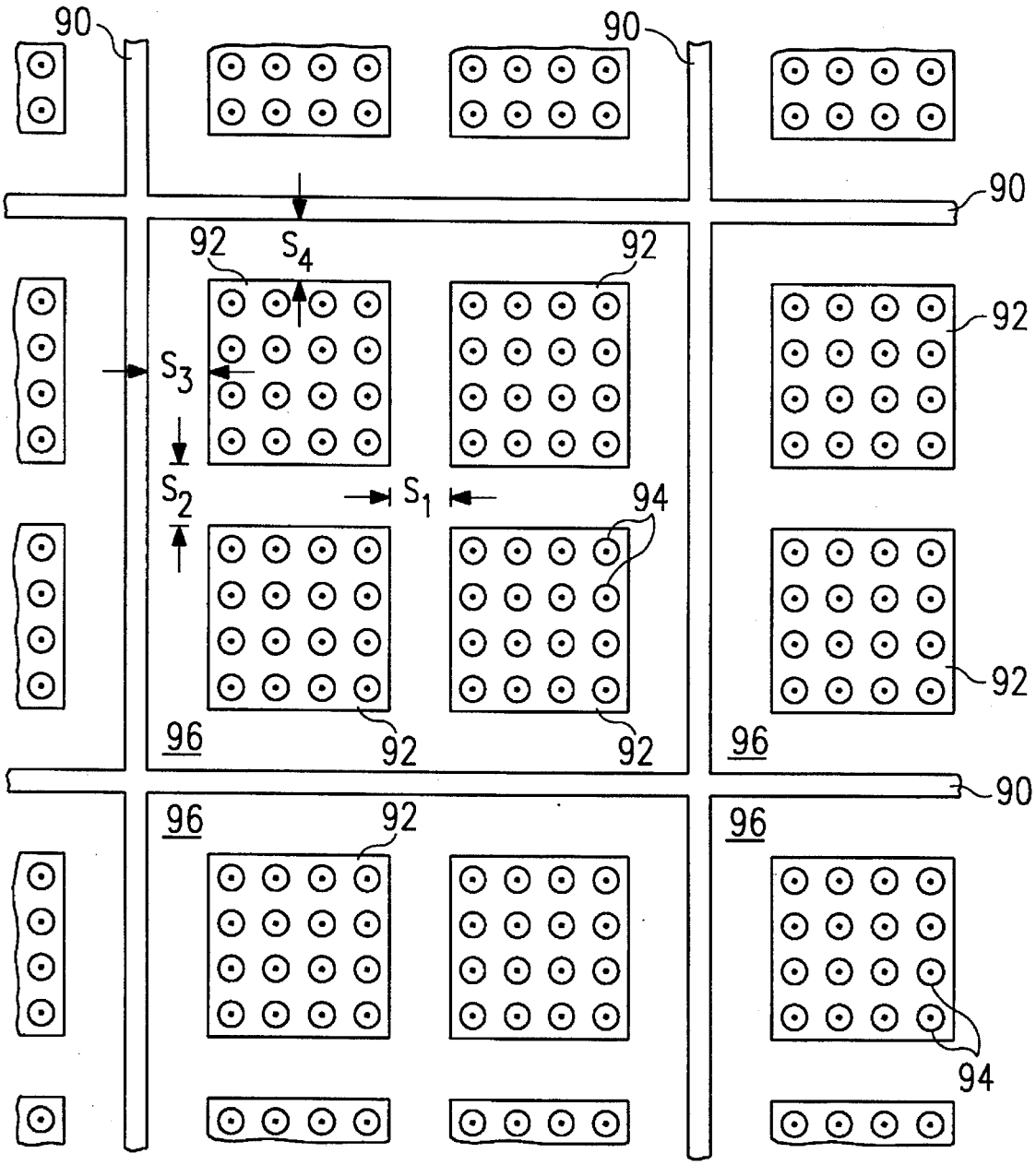
FIG. 7 is a plan view of a second arrangement of the emitter clusters of the present invention.

Referring now to FIG. 7, there is shown a plan view of a second arrangement of emitter clusters according to the present invention. In a perspective similar to that of FIG. 6, the view of FIG. 7 illustrates a mesh structure 90 of conductors, four conductive plates 92 within each of the spaces formed by mesh structure 90, a plurality of microtips 94 on each of the conductive plates 92, and regions 96 of resistive material in the spacings between mesh conductor 90 and conductive plates 92. In this illustrated embodiment, microtips 94 are formed as a four-by-four array on conductive plates 92, all of the plates 92 including an equal number of microtips 94.

It will be easily recognized that conductive plates 92 may be positioned symmetrically within the spacings of mesh conductor 90 such that plates 92 have an equal resistance path from conductor 90. Hence, there will be an equal resistance between conductor 90 and each microtip 94 on a conductive plate 92, regardless of the number of microtips 94 on a plate 92, the resistance value being determined generally by the lengths of the sides of plates 92 adjacent conductor 90, the distances between plates 92 and conductor 90, and the sheet resistance of the material in region 96. Hence, each microtip 94 on a plate 92 is at an equal potential, regardless of its position on the plate, and should display equal emission and degradation characteristics.

The embodiment of FIG. 7 provides an advantage of increased density of microtips over the embodiment of FIG. 6. Because of symmetry considerations, all of the conductive plates 92 within each mesh spacing have an equal resistance path to mesh conductor 90. Thus, although the voltage levels of conductive plates 92 float, they are substantially equal, differing only as a result of variations in the emission characteristics of microtips 94. The inter-plate spacings $s_1$ and $s_2$ can be minimal, and significantly less than the spacings $s_3$ and $s_4$, between plates 92 and mesh conductor 90, the latter spacings establishing the ballast resistance of microtips 94.

The number of clustered microtips on conductive plate 82 (of FIG. 6) and conductive plate 92 (of (FIG. 7) is a design choice. An upper limit is determined in part by the small probability of a failed microtip, recognizing that the relatively rare occurrence of a microtip shorted to the gate electrode effectively causes a short circuit of all microtips in that cluster, resulting in no emission of electrons from any of the microtips of that cluster. On the other hand, a large number of microtips clustered on each conductive plate is desirable from a standpoint of reducing the total emission required by each microtip, as well as minimizing the effects of variations in emission characteristics among the clustered microtips.

While the embodiments of FIGS. 6 and 7 represent two configurations in which conductive plates are positioned within the spacings of a conductive mesh structure so as to provide equal resistance paths between the conductive mesh and each of the conductive plates, it is anticipated that many more such configurations may be envisioned, e.g., differences in the shapes of the conductive plates and differences in the positional relationships between the plates and the conductive mesh, all of which provide the same or similar advantages as the illustrated embodiments, and all of which accord with the principles of the present invention. Furthermore, it is recognized that configurations of the mesh structure, other than the square spacings illustrated herein, may be used without departing from the principles of the present invention, e.g., rectangular, triangular or hexagonal (honeycomb) spacings.

Figure 8:
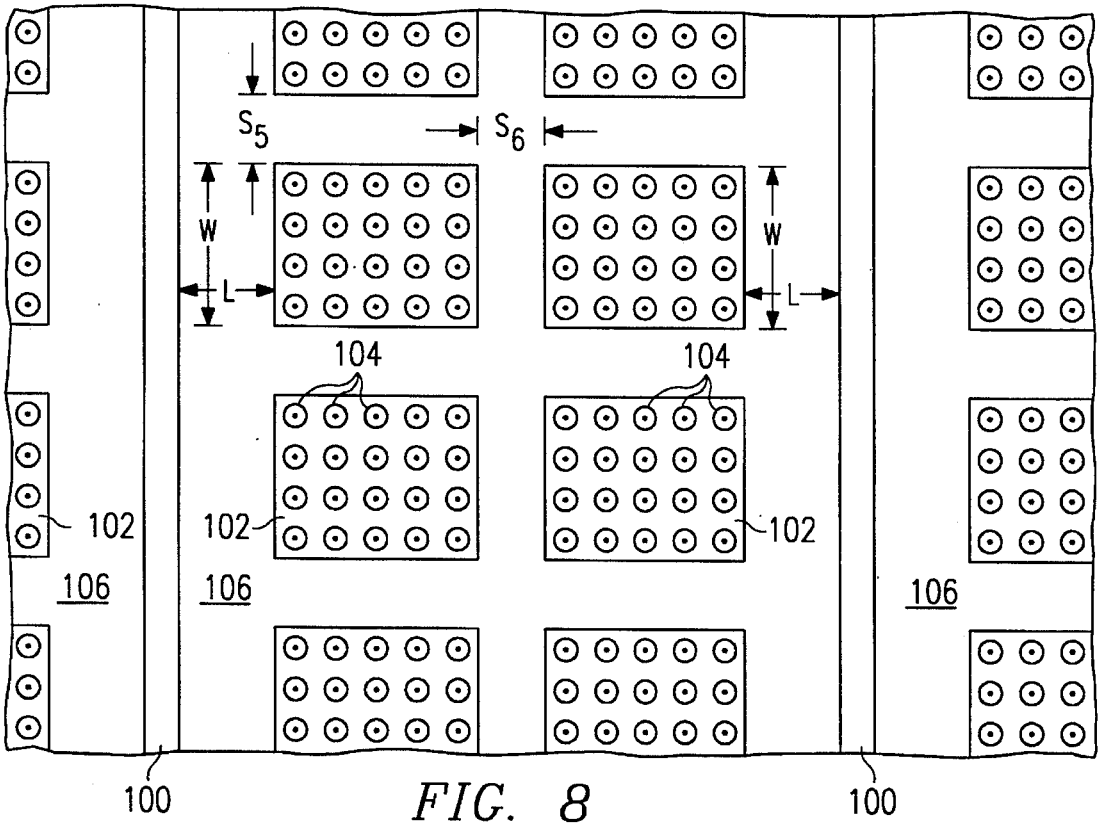
FIG. 8 is a plan view of a first arrangement of emitter clusters in relation to a conductive column line in accordance with the present invention.

Referring now to FIG. 8, there is shown a plan view of an arrangement of emitter clusters in relation to a conductive column line in accordance with the present invention. In a perspective similar to that of FIGS. 6 and 7, the view of FIG. 8 illustrates a striped structure 100 of conductors, a plurality of conductive plates 102, each adjacent and laterally spaced from a corresponding stripe conductor 100, a plurality of microtips 104 on each of the conductive plates 102, and regions 106 of resistive material in the spacings between conductive stripes 100 and conductive plates 102. As illustrated, conductive stripes 100 are substantially parallel to each other, and are spaced from one another by two conductive plates 102. In this illustrated embodiment, microtips 104 are formed as a five-by-four array on conductive plates 102, all of the plates 102 including an equal number of microtips 104.

The current carried to the cluster of microtips 104 on each of the conductive plates 102 is a function of the resistance value of the thin film resistor formed by resistive layer 106 between column stripe conductor 100 and conductive plate 102. In the illustrated example, this resistance value is directly related to the sheet resistance of layer 106 and dimension L, the distance between conductive plate 102 and stripe conductor 100, and inversely related to dimension W, the width of conductive plate 102 adjacent conductor 100. The effect of small spacings $s_5$ and $s_6$ between adjacent conductive plates 102 is similar to that discussed in relation to the embodiment of FIG. 7, but with the additional advantages provided by the increased density of conductive plates 102 offered by the embodiment of FIG. 8.

The arrangement described in relation to the embodiments of FIG. 7 and FIGS. 8, 9 and 11, and, to a somewhat lesser extent, the embodiments of FIGS. 3–5, 6 and 10, allow the density of microtips within a display pixel to be improved through several design and material tradeoff decisions. First, the cluster spacings, i.e., the spacings $s_1$ through $s_6$, can be made to exceed 2 microns to allow use of projection printing techniques, or may be made smaller than 2 microns to maximize the cluster packing through use of stepper printing techniques. Second, the cluster spacings can be made to exceed 2 microns to facilitate etching of their conductive layer by wet chemical means, or may be made smaller than 2 microns to maximize the cluster packing through use of plasma etching technologies. Third, the cluster spacings may be set to zero value, creating a continuous array that is limited only by the dimensions of the pixel. Fourth, the length of the cluster resistor, dimension L, the distance between conductive plate 102 and stripe conductor 100 in FIG. 8, may be reduced without affecting the resistance value by use of a resistive layer with higher sheet resistance, e.g., a thinner layer or a more lightly doped material. Reduction in the length of dimension L is limited, of course, by the breakdown field between stripe conductor 100 and conductive plate 102. Finally, the cluster resistor value can be reduced without affecting length of the cluster resistor, dimension L, by enlarging dimension W, the width of conductive plate 102 adjacent conductor 100 in FIG. 8, while holding the sheet resistance value of the resistive layer 106 constant.

Figure 9:
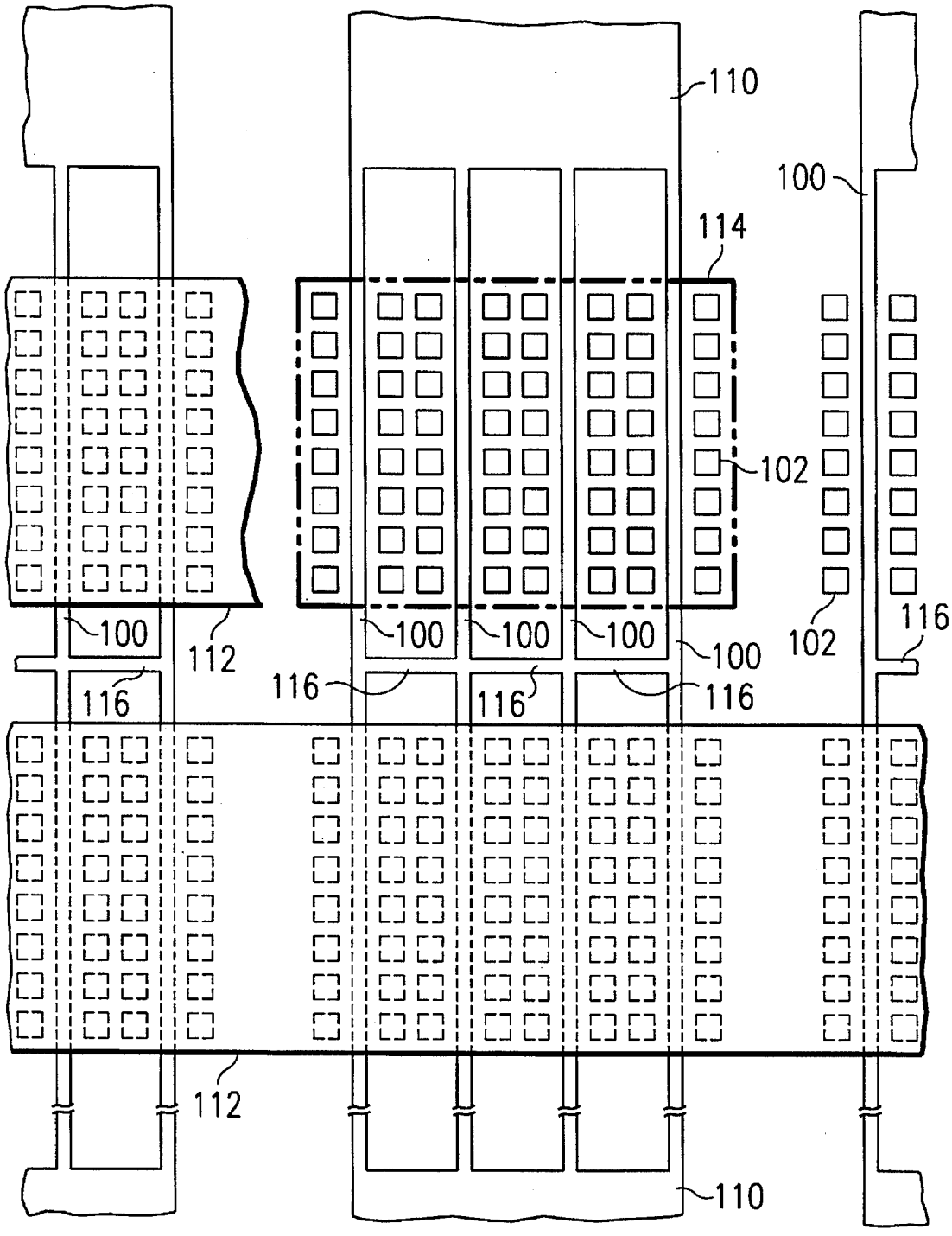
FIG. 9 is a plan view of an arrangement of pixels including the emitter clusters and conductive column lines of the present invention.

Referring now to FIG. 9, there is shown a plan view of an arrangement of pixels including the emitter clusters and conductive column lines of the present invention. This arrangement illustrates column conductors comprising stripes 100 and a plurality of conductive plates 102, each adjacent and laterally spaced from a corresponding stripe conductor 100. As illustrated, conductive stripes 100 are substantially parallel to each other, and are spaced from one another by two conductive plates 102. Stripe conductors 100 are joined at their upper and lower extremities (outside the active region of the display) by conductive bus regions 110. Column conductors 100 and crossed by, and electrically isolated from, row conductors 112 which, as illustrated, are orthogonal to stripe conductors 100. Region 114, comprising the intersection of the striped column conductors 100 which are joined by a single bus region 110 at each end thereof (the cathode electrode) and a single row conductor (the gate electrode) may represent a single display pixel. Optional cross-line conductors 116 in the inactive area between display pixels may be added for redundancy and current spreading.

While the embodiment of FIGS. 8 and 9 represent a typical configuration in which conductive plates are positioned adjacent a stripe conductor structure so as to provide equal resistance paths between the conductive stripes and each of the conductive plates, it is anticipated that many more such configurations may be envisioned, e.g. , differences in the shapes of the conductive plates and differences in the positional relationships between the plates and the stripes, all of which provide the same or similar advantages as the illustrated embodiments, and all of which accord with the principles of the present invention.

A method for fabricating an emitter plate of the embodiment of FIGS. 8 and 9, in accordance with the present invention, may comprise the following steps: providing an insulating substrate; depositing a layer of $SiO_2$ on the substrate; forming a layer 106 of an electrically resistive material over the $SiO_2$ layer; depositing a layer of conductive material on resistive layer 106 and forming therefrom conductive plates 102, conductive column stripes 100, bus regions 110 and (optionally) cross-line conductors 116, typically by photolithographic and etching processes; forming an electrically insulating layer overlying resistive layer 106, conductive plates 102 and conductive column stripes 100; depositing a layer of conductive material on the insulating layer and forming row conductors 112 therefrom, typically by photolithographic and etching processes; forming a plurality of apertures in row conductors 112 over conductive plates 102, the apertures extending through the insulating layer down to conductive plates 102; and forming microtip emitters 104 on conductive plates 102, each emitter 104 formed within one of the apertures in row conductors 112. The particulars of illustrative materials and dimensions, and illustrative methods of forming the layers, structures, apertures and microtips of the emitter plate of FIGS. 8 and 9 may be easily determined from an understanding of the above-described process of fabricating emitter structure 60 described in relation to FIG. 3.

Alternatively, another method tier fabricating an emitter plate of the embodiment of FIGS. 8 and 9, in accordance with the present invention, may comprise the following steps: providing an insulating substrate; depositing a layer of $SiO_2$, on the substrate; depositing a layer of conductive material on the $SiO_2$ layer and forming therefrom conductive column stripes 100, bus regions 110 and (optionally) cross-line conductors 116, typically by photolithographic and etching processes; forming a layer 106 of an electrically resistive material over the $SiO_2$ layer and conductive column stripes 100; depositing a layer of conductive material on resistive layer 106 and forming therefrom conductive plates 102, typically by photolithographic and etching processes; forming an electrically insulating layer overlying resistive layer 106 and conductive plates 102; depositing a layer of conductive material on the insulating layer and forming row conductors 112 therefrom, typically by photolithographic and etching processes; forming a plurality of apertures in row conductors 112 over conductive plates 102, the apertures extending through the insulating layer down to conductive plates 102; and forming microtip emitters 104 on conductive plates 102, each emitter 104 formed within one of the apertures in row conductors 112.

Figure 11:
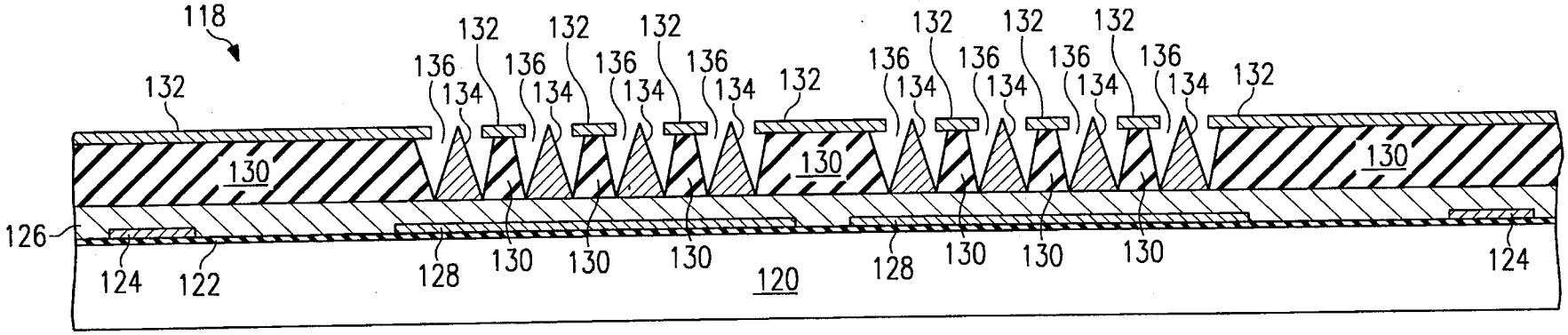
FIG. 11 is a cross-sectional view of a second arrangement of emitter clusters adjacent conductive column lines in accordance with the present invention.

Referring now to FIG. 11, there is shown a cross-sectional view of an emitter plate 118 embodying a second arrangement of emitter clusters adjacent conductive column lines in accordance with the present invention. In a perspective similar to that of FIG. 10, the view of FIG. 11 illustrates a substrate 120 having an optional thin insulating layer 122 overlaid thereon. A plurality of stripe conductors 124, extending perpendicular to the drawing sheet, are located on layer 122, as are a plurality of conductive plates 128. The relative positioning of stripe conductors 124 and conductive plates 128, is the same as for FIG. 8, wherein plates 128 are each adjacent and laterally spaced from a corresponding stripe conductor 124. A coating 126 of a resistive material overlies insulating layer 122, stripe conductors 126 and conductive plates 128. An insulating layer 130 covers resistive coating 126, and a conductive layer 132 overlies insulating layer 130. Apertures 136 are formed through conductive layer 132 and insulating layer 130 down to the upper surface of resistive layer 126. Apertures 136 are formed directly above conductive plates 128. Microtip emitters 134, illustratively in the shape of cones, are formed on the upper surface of resistive layer 126 within apertures 136.

In this arrangement, stripe conductors 124 comprise the cathode electrode, and conductive layer 132 comprises the gate electrode of field emission device 118. Electron emission from microtip emitters 134 is effected by the application of a potential at stripe conductors 124 which is positive with respect to the potential on conductive layer 132.

The structure shown in FIG. 11 may include a typical thickness dimension of resistive layer 126 between microtip emitters 134 and conductive plate 128 of one micron, and a typical lateral spacing between each conductive plate 128 and the adjacent stripe conductor 124 of five microns. Thus, the arrangement of FIG. 11 provides a relatively small vertical ballast resistance between each microtip emitter 134 and the conductive plate 128 thereunder, and a considerably larger lateral ballast resistance between each conductive plate 128 and the adjacent stripe conductor 124.

A method for fabricating emitter plate 118, in accordance with the present invention, may comprise the following steps: providing an insulating substrate 120; depositing a layer 122 of $SiO_2$ on substrate 120; depositing a layer of a conductive material, illustratively aluminum, chromium, molybdenum or niobium, on the $SiO_2$ layer 122 and forming therefrom conductive plates 128, column stripes 124, and bus regions and cross-line conductors of the type shown in FIG. 9, typically by photolithographic and etching processes; forming a layer 126 of an electrically resistive material, illustratively amorphous silicon, over conductive column stripes 124 and conductive plates 128; forming an electrically insulating layer 130 overlying resistive layer 126; depositing a layer of conductive material, illustratively niobium, on insulating layer 130 and forming row conductors 132 therefrom, typically by photolithographic and etching processes; forming a plurality of apertures 136 in row conductors 132 over conductive plates 128, the apertures extending through insulating layer 130 down to resistive layer 126; and forming microtip emitters 134, illustratively of molybdenum, on resistive layer 126, each emitter 134 formed within one of the apertures 136 in row conductors 132.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. Electron emission apparatus comprising:

an insulating substrate;

a conductive mesh structure on said substrate;

a conductive plate on said substrate within a spacing formed by said mesh structure and electrically isolated therefrom;

a resistive layer overlying said conductive plate and in electrical contact with said mesh structure;

a conductive layer overlying said conductive plate and spaced apart from said plate, said conductive layer having apertures formed therein; and a plurality of microtip emitters on said resistive layer and located above said conductive plate, each of said emitters formed within a corresponding one of said apertures in said conductive layer.

2. The electron emission apparatus in accordance with claim 1 wherein the distance between said conductive plate and said mesh structure is substantially greater than the thickness of said resistive layer overlying said conductive plate.

3. The electron emission apparatus in accordance with claim 1 further including means for applying a potential between said conductive mesh structure and said conductive layer.

4. The electron emission apparatus in accordance with claim 1 wherein said mesh structure comprises a cathode electrode and said conductive layer comprises a gate electrode.

5. The electron emission apparatus in accordance with claim 1 wherein said apertures are formed in said conductive layer as an array.

6. The electron emission apparatus in accordance with claim 1 wherein said apertures in said conductive layer are generally circular and said microtip emitters are generally cone-shaped.

7. The electron emission apparatus in accordance with claim 1 wherein said resistive layer comprises amorphous silicon.

8. The electron emission apparatus in accordance with claim 1 wherein said microtip emitters comprise molybdenum.

9. The electron emission apparatus in accordance with claim 1 wherein the material of said conductive plate is selected from the group comprising aluminum, chromium, molybdenum and niobium.

10. The electron emission apparatus in accordance with claim 1 wherein the material said conductive mesh structure is selected from the group comprising aluminum, chromium, molybdenum and niobium.

11. The electron emission apparatus in accordance with claim 1 wherein said conductive layer comprises niobium.

12. Electron emission apparatus comprising:

an insulating substrate;

a conductor formed as a mesh structure on said substrate, said mesh structure defining mesh spaces;

conductive plates on said insulating substrate occupying areas within said mesh spaces;

a layer of an electrically resistive material on said substrate overlying said mesh structure and said conductive plates;

an electrically insulating layer on said resistive layer;

a conductive layer on said insulating layer, said conductive layer having a plurality of apertures formed therein and extending through said insulating layer;

microtip emitters on said resistive layer, each emitter formed within a corresponding one of said apertures in said conductive layer.

13. The electron emission apparatus in accordance with claim 12 wherein each of said mesh spaces is substantially square.

14. The electron emission apparatus in accordance with claim 12 wherein each of said conductive plates includes an equal number of emitters.

15. The electron emission apparatus in accordance with claim 12 wherein each of said conductive plates are substantially equally spaced from said conductor.

16. The electron emission apparatus in accordance with claim 15 wherein the distance between each of said conductive plates and said conductor is substantially greater than the thickness of said resistive layer overlying each of said conductive plates.

17. The electron emission apparatus in accordance with claim 12 wherein each of said emitters has a substantially equal resistance path to its adjacent conductive plate.

18. The electron emission apparatus in accordance with claim 12 wherein each of said conductive plates has a substantially equal resistance path to said conductor.

19. The electron emission apparatus in accordance with claim 18 wherein each of said emitters has a substantially equal resistance path to its adjacent conductive plate.

20. The electron emission apparatus in accordance with claim 19 wherein the resistance path between each of said conductive plates and said conductor is substantially greater than the resistance path between each of said emitters and their adjacent conductive plates.

21. The electron emission apparatus in accordance with claim 12 further including means for applying a potential between said conductor and said conductive layer.

22. The electron emission apparatus in accordance with claim 12 wherein said conductor comprises a cathode electrode and said conductive layer comprises a gate electrode.

23. Apparatus comprising:

a conductive mesh structure;

a conductive plate within a spacing formed by said mesh structure and electrically isolated therefrom;

a resistive layer overlying said conductive plate and in electrical contact with said mesh structure; and a plurality of microtip emitters on said resistive layer and located above said conductive plate.

24. The apparatus in accordance with claim 23 wherein the distance between said conductive plate and said mesh structure is substantially greater than the thickness of said resistive layer overlying said conductive plate.

25. The apparatus in accordance with claim 23 further including a conductive layer overlying said resistive layer and electrically isolated therefrom, said conductive layer having apertures formed therein, each of said emitters being formed within a corresponding one of said apertures in said conductive layer.

26. The apparatus in accordance with claim 25 further including means for applying a potential between said conductive mesh structure and said conductive layer.

27. The apparatus in accordance with claim 25 wherein said mesh structure comprises a cathode electrode and said conductive layer comprises a gate electrode.

28. The apparatus in accordance with claim 25 wherein said apertures are formed in said conductive layer as an array.

29. The apparatus in accordance with claim 25 wherein said apertures in said conductive layer are generally circular and said microtip emitters are generally cone-shaped.

30. The apparatus in accordance with claim 25 wherein said conductive layer comprises niobium.

31. The apparatus in accordance with claim 23 wherein said resistive layer comprises amorphous silicon.

32. The apparatus in accordance with claim 23 wherein said microtip emitters comprise molybdenum.

33. The apparatus in accordance with claim 23 wherein the material of said conductive plate is selected from the group comprising aluminum, chromium, molybdenum and niobium.

34. The apparatus in accordance with claim 23 wherein the material said conductive mesh structure is selected from the group comprising aluminum, chromium, molybdenum and niobium.

* * * * *